US008151411B2

(12) United States Patent
Beskow et al.

(10) Patent No.: US 8,151,411 B2
(45) Date of Patent: Apr. 10, 2012

(54) VACUUM CLEANER

(75) Inventors: Jonas Beskow, Stockholm (SE); Håkan Miefalk, Järfälla (SE); Oskar Fjellman, Stockholm (SE); Christian Ågren, Stockholm (SE); Esbjörn Svantesson, Täby (SE)

(73) Assignee: AB Electrolux, Stockholm (SE)

( * ) Notice: Subject to any disclaimer, the term of this patent is extended or adjusted under 35 U.S.C. 154(b) by 153 days.

(21) Appl. No.: 12/296,852

(22) PCT Filed: Apr. 10, 2007

(86) PCT No.: PCT/SE2007/000335

§ 371 (c)(1),
(2), (4) Date: Sep. 29, 2009

(87) PCT Pub. No.: WO2007/117197

PCT Pub. Date: Oct. 18, 2007

(65) Prior Publication Data

US 2010/0017997 A1 Jan. 28, 2010

(30) Foreign Application Priority Data

Apr. 10, 2006 (SE) ..... 0600821

(51) Int. Cl.
*A47L 9/00* (2006.01)

(52) U.S. Cl. ..... 15/410; 15/350; 15/323; 15/22.1; 15/143.1; 15/230.11; 15/244.2

(58) Field of Classification Search ..... 15/323, 15/350, 351, 410, 22.1, 120.2, 143.1, 230.11, 15/244.2; 81/22, 20, 489; 403/265, 266, 403/268; *A47L 9/00*

See application file for complete search history.

(56) References Cited

U.S. PATENT DOCUMENTS

| | | | |
|---|---|---|---|
| 2,707,792 | A | 5/1955 | Waller |
| 2,863,524 | A | 12/1958 | Buda |
| 3,199,138 | A | 8/1965 | Nordeen |
| 3,621,640 | A | 11/1971 | Ohno et al. |
| 3,653,189 | A | 4/1972 | Miyake et al. |
| 3,906,219 | A | 9/1975 | Stauffer |
| 4,213,224 | A | 7/1980 | Miller |
| 4,276,070 | A | 6/1981 | Hug |
| 4,376,322 | A | 3/1983 | Lockhart et al. |

(Continued)

FOREIGN PATENT DOCUMENTS

CA 2087056 7/1994

(Continued)

OTHER PUBLICATIONS

"The Boss, Heavy Duty Rechargeable Vacuum, Model 98," Eureka brochure dated 1998, 2 pages.

Black & white printouts of http://www.igia.com/prodetail.cfm?ID=AT7290 "IGIA Vac Blue" (3 pages).

Black & white printouts of http://www.igia.com/prodetail.cfm?ID=AT7691 "Wind Storm Wet/Dry Vacuum" (1 page).

(Continued)

*Primary Examiner* — David Redding
(74) *Attorney, Agent, or Firm* — Hunton & Williams

(57) ABSTRACT

The invention relates to a vacuum cleaner of a type comprising an elongated support body (1) including a handle (3) in an upper end of the support body, a nozzle device attached to a lower end of the support body by means of a rotatable joint, and a vacuum unit, including an electric motor, a fan and a debris collecting compartment, being accommodated in the support body. An upper portion of the support body (1) is provided with a layer (7, 8) of a slip reducing material at least on a rear surface thereof.

9 Claims, 3 Drawing Sheets

U.S. PATENT DOCUMENTS 4,421,964 A 12/1983 Buchtel
4,467,493 A 8/1984 Buchtel
4,541,142 A 9/1985 Pudwill
4,545,089 A 10/1985 Oxel
4,573,234 A 3/1986 Kochte et al.
4,573,237 A 3/1986 Kochte et al.
4,621,390 A 11/1986 Hampton et al.
4,635,315 A 1/1987 Kozak
4,665,582 A 5/1987 Richmond et al.
4,670,701 A 6/1987 Sako et al.
4,704,765 A 11/1987 Ataka
4,748,713 A 6/1988 Sepke et al.
4,766,638 A 8/1988 McDowell
4,787,923 A 11/1988 Fleigle et al.
4,804,481 A 2/1989 Lennartz
D300,214 S 3/1989 Adams
4,821,366 A 4/1989 Levine
4,831,685 A 5/1989 Bosyj et al.
4,841,594 A 6/1989 Elson et al.
D304,104 S 10/1989 Busalt et al.
4,876,763 A 10/1989 Cho et al.
4,894,882 A 1/1990 Toya
4,899,418 A 2/1990 Steiner et al.
D307,657 S 5/1990 Li
4,920,606 A 5/1990 Gerke, Jr. et al.
4,920,608 A 5/1990 Hult et al.
4,928,346 A 5/1990 Elson et al.
4,934,020 A 6/1990 Jackson
4,942,641 A 7/1990 Gerke, Jr. et al.
4,947,514 A 8/1990 Gerke, Jr. et al.
4,967,443 A 11/1990 Krasznai et al.
4,993,106 A 2/1991 Hult et al.
5,005,252 A 4/1991 Steiner et al.
5,020,187 A 6/1991 Kosten et al.
5,025,529 A 6/1991 Hult et al.
5,035,024 A 7/1991 Steiner et al.
5,065,473 A 11/1991 Krasznai et al.
5,107,567 A 4/1992 Ferrari et al.
5,226,820 A * 7/1993 Pearson ..... 434/247
5,309,600 A 5/1994 Weaver et al.
5,322,534 A 6/1994 Kaiser
5,342,433 A 8/1994 Avondoglio
D352,807 S 11/1994 Sanderud
D364,013 S 11/1995 Klingspor et al.
5,524,321 A 6/1996 Weaver et al.
5,561,885 A 10/1996 Zahuranec et al.
5,584,095 A 12/1996 Redding et al.
5,603,740 A 2/1997 Roy
5,661,885 A 9/1997 Donato
5,715,566 A 2/1998 Weaver et al.
5,733,351 A 3/1998 Hult et al.
5,819,364 A 10/1998 Sham
5,869,947 A 2/1999 Zahuranec et al.
5,966,774 A 10/1999 Bone et al.
6,029,313 A 2/2000 O'Dea et al.
6,094,775 A 8/2000 Behmer
6,108,864 A 8/2000 Thomas et al.
6,122,796 A 9/2000 Downham et al.
6,125,498 A 10/2000 Roberts et al.
6,131,239 A 10/2000 White
6,146,434 A 11/2000 Scalfani et al.
6,189,178 B1 2/2001 Roberts
6,311,366 B1 11/2001 Sepke et al.
6,324,714 B1 12/2001 Walz et al.
6,428,589 B1 8/2002 Bair et al.
6,434,785 B1 8/2002 Vandenbelt et al.
6,546,592 B1 4/2003 Cockburn et al.
6,562,093 B2 5/2003 Oh
6,571,421 B1 6/2003 Sham et al.
6,625,845 B2 9/2003 Matsumoto et al.
6,647,587 B1 11/2003 Ohara et al.
6,658,693 B1 12/2003 Reed, Jr.
6,736,873 B2 5/2004 Conrad et al.
6,766,558 B1 7/2004 Matsumoto et al.
6,775,882 B2 8/2004 Murphy et al.
6,811,584 B2 11/2004 Oh
6,824,580 B2 11/2004 Oh
6,839,934 B2 1/2005 Houghton et al.
6,857,165 B2 2/2005 Oh
6,928,690 B2 * 8/2005 Ji ..... 15/339
6,948,211 B2 9/2005 Stephens et al.
6,964,082 B2 11/2005 Hsu
6,968,596 B2 11/2005 Oh et al.
7,159,810 B1 * 1/2007 Miller ..... 241/168
7,377,007 B2 5/2008 Best
7,383,609 B2 * 6/2008 Ji ..... 15/410
7,386,916 B2 6/2008 Bone
7,404,838 B1 7/2008 Pathak
7,412,749 B2 8/2008 Thomas et al.
7,507,269 B2 3/2009 Murphy et al.
2002/0042969 A1 4/2002 Nagai et al.
2002/0073504 A1 6/2002 Hall et al.
2002/0189048 A1 12/2002 Maruyama et al.
2003/0019073 A1 1/2003 Oh
2003/0159235 A1 8/2003 Oh
2003/0163887 A1 9/2003 Inoue
2003/0208879 A1 11/2003 Oh et al.
2003/0213091 A1 11/2003 Oh et al.
2004/0040270 A1 3/2004 Inoue et al.
2004/0098957 A1 5/2004 Yoo et al.
2004/0103496 A1 6/2004 Worwag
2004/0134022 A1 7/2004 Murphy et al.
2004/0177471 A1 9/2004 Jung et al.
2004/0187253 A1 9/2004 Jin et al.
2004/0200029 A1 10/2004 Jin et al.
2004/0216263 A1 11/2004 Best
2004/0261212 A1 12/2004 Park et al.
2004/0261213 A1 12/2004 Park et al.
2005/0005390 A1 1/2005 Lee et al.
2005/0005391 A1 1/2005 Park
2005/0081321 A1 4/2005 Milligan et al.
2005/0125939 A1 6/2005 Hansen et al.
2005/0125940 A1 6/2005 McDowell
2005/0183406 A1 8/2005 Coburn
2005/0233114 A1 * 10/2005 Chi ..... 428/156
2006/0064828 A1 3/2006 Stein et al.
2006/0090290 A1 5/2006 Lau
2006/0156508 A1 7/2006 Khalil
2007/0163075 A1 * 7/2007 Butler et al. ..... 15/410
2007/0271724 A1 11/2007 Hakan et al.

FOREIGN PATENT DOCUMENTS

CN 1272873.X 1/2003
DE G 79 29 844.5 3/1981
DE 32 28 491 A1 2/1984
DE 33 09 162 A1 9/1984
DE 33 25 336 1/1985
DE 8623004 10/1986
DE 37 43 083 A1 6/1989
DE G 90 10 066.2 10/1991
DE G 91 14 371.3 4/1992
DE 4038262 6/1992
DE 19630286 1/1998
DE 10110581 11/2001
DE 10124216 1/2002
EP 0 170 720 2/1986
EP 0 215 619 A2 3/1987
EP 0 827 710 A2 3/1998
EP 0 853 917 7/1998
EP 0914795 A2 12/1999
EP 1 070 478 1/2001
EP 1 224 898 7/2002
EP 1 279 362 1/2003
FR 2603181 6/1987
GB 857580 12/1960
GB 990065 4/1965
GB 1201841 8/1970
GB 2035787 A 6/1980
GB 2137896 10/1984
GB 2155314 9/1985
GB 2189382 A 10/1987
GB 2268875 1/1994
GB 2291790 7/1994
GB 2 349 105 10/2000
GB 2 372 434 8/2002
GB 2398486 A 8/2004
GB 2413942 11/2005

| | | | |
|---|---|---|---|
| JP | 54-100149 | | 8/1979 |
| JP | 3-267032 | | 11/1991 |
| JP | 4364822 | | 12/1992 |
| JP | 52-73557 | | 10/1998 |
| JP | 2000-070198 | | 3/2000 |
| JP | 2001-095735 | | 4/2001 |
| JP | 2001353110 | | 12/2001 |
| JP | 2002 085297 | A | 3/2002 |
| JP | 2002 136456 | A | 5/2002 |
| JP | 2003 275154 | A | 9/2003 |
| SE | 514314 | C2 | 3/1998 |
| SE | 510283 | C2 | 10/1998 |
| WO | WO 97/20492 | | 6/1997 |
| WO | WO 03/009736 | | 2/2003 |
| WO | WO 2004/069021 | | 8/2004 |
| WO | WO 2005/111084 | | 11/2005 |

OTHER PUBLICATIONS

Black & white printouts of http://www.igia.com/prodetail.cfm?ID=AT7739 "Wind Storm Vacuum" (3 pages).

Black & white printouts of http://www.sewserg.com/products/abp02698.html Miele S147 Little Giant Plus Vacuum Cleaner with Free 5 Yr Extended Warranty/Replacement (3 pages).

Black & white printouts of http://www.sewserg.com/products/abp09802-0775.html "Wind Storm AT7813 3in1 Upright, Stick & Hand Held Bagless Vacuum Cleaner Windstorm, 4 Attachments, Fold Down Handle for Storage, Weighs under 8 Pounds" (3 pages).

Black & white printouts of http://www.zweita.net/ "Product Info" (3 pages).

Fakir product pages catalogue, 2002 (5 pages).

* cited by examiner

VACUUM CLEANER

The invention relates to a vacuum cleaner of a type comprising an elongated support body including a handle in an upper end of the support body, a nozzle device attached to a lower end of the support body by means of a rotatable joint, and a vacuum unit, including an electric motor, a fan and a debris collecting compartment, being accommodated in the support body.

BACKGROUND OF THE INVENTION

Vacuum cleaners of the above specified kind have become common on the market during recent years. They possess an advantage in relation to conventional vacuum cleaners by the fact that the entire vacuum cleaner is assembled into one single unit instead of a separate vacuum unit, which during work will be dragged over the floor, and a separate hose and tube provided with a nozzle device in the end. The design of a vacuum cleaner according to the preamble is more compact which will facilitate the cleaning work.

Many of these vacuum cleaners are provided with a vacuum unit, which is detachable from the stick formed support body and provided with an integrated nozzle in a forward end, such that it can be used as a handheld, lightweight vacuum cleaner. This makes the vacuum cleaner more versatile in relation to conventional vacuum cleaners. I.a. such a vacuum cleaner can be used for vacuum-cleaning of for instance floors, wherein the work may be performed comfortably in a standing, upright position for the person or operator performing the work. However, it can also be used as a handheld, lightweight vacuum cleaner for cleaning of spots difficult to access, table tops, window boards and the like, by detaching the vacuum unit from the support body. For this reason the integrated nozzle in the forward end of the vacuum unit integrated nozzle in the forward end of the vacuum unit is connectable to the support body to set the vacuum unit in fluid communication with the nozzle device in the lower end of the support body. Most of these vacuum cleaners are provided with a chargeable battery in the vacuum unit, to allow vacuum operation without the need for a mains supply cable, above all when it is used as a lightweight, handheld vacuum cleaner, but preferably also when it is used as a stick formed vacuum cleaner.

To facilitate working with this kind of vacuum cleaner, the nozzle device in the lower end of the support body is preferably provided with wheels, castors or the like on the bottom side, which will bear and roll against the floor during cleaning. Such wheels will to a large extent facilitate working with the vacuum cleaner since the entire weight is carried by the support body, which is maneuvered back and forth by the operator, and consequently the wheels will make it considerably easier to move the vacuum cleaner.

However, most of these vacuum cleaners can not stand upright by themselves. In most cases the vacuum cleaner is delivered with a stand for storing, and possibly charging of batteries, when it is not in use. However, this stand can not be carried along during work. Accordingly, due to the comparatively large weight and the movable joint between the support body and the nozzle device, it has appeared that the vacuum cleaner is difficult to temporarily put aside, e.g. for taking a brake or to allow the operator to have the hands free for doing something else. When the nozzle device in addition is provided with wheels, this difficulty to temporarily put aside the vacuum cleaner is increased as a consequence of the high movability due to the wheels in the nozzle device. Consequently, the vacuum cleaner can not stand by itself and if the vacuum cleaner is leaned against for example a table or a wall, it tends to slip away and fall to the floor, either by the wheels in the nozzle device rolling straight forward or by the stick tipping sideways due to rotation in the joint between the support body and the nozzle device. This is a problem since on the one hand, the vacuum cleaner can get damaged or the vacuum cleaner may knock down furnishings and the like. Accordingly, the user is often forced to lay the vacuum cleaner flat on the floor when it is desirable to temporarily do something else. This makes the work considerably more strenuous and time-consuming.

SUMMARY OF THE INVENTION

The object of the invention is to improve vacuum cleaners of the above indicated kind. More precisely, it is an object to admit a stick formed vacuum cleaner to temporarily be set aside, leaned towards an object without the risk of the vacuum cleaner to slip or tip to the floor. At least this object is achieved by a vacuum cleaner according to claim 1.

The invention is thus based on the understanding that the above-mentioned object can be achieved by a stick formed vacuum cleaner, wherein at least one friction increasing and slip reducing layer is provided on at least an upper portion of the rear side of the stick formed support body. With a vacuum cleaner formed in this way it is possible to temporarily set it aside quickly and easily without the risk for the vacuum cleaner to fall to the floor by sliding or tipping with the possible risk for the vacuum cleaner to get damaged or that it will cause damage to furnishings. In this way the operator also do not need to bend down to place the vacuum cleaner on the floor or to pick it up.

Within this general idea, the invention may be carried out in many different ways. In a most preferred embodiment, the vacuum cleaner is provided with an elongated strip of a slip reducing material attached to an upper portion of a rear side of the support body. However, in most cases it is preferred that the slip reducing material is not positioned on the rear side of a handle part, since it can feel somewhat unpleasant to grip around the strip of a high friction material. This maybe also can give a little too good grip for the hands, while it is desirable to allow some sliding between the hands and the handle during moving of the vacuum cleaner. In a preferred embodiment, the handle part is formed as a short portion in the upper part of the support body which is slightly angled in relation to the rest of the support body, and the slip reducing strip is attached from the handle portion and a distance downwards. By making the strip somewhat elongated, the advantage is obtained that the vacuum cleaner may be leaned towards an object, for example a table top, in different desirable angles, or towards objects having different heights, while the slip reducing strip still engages the object.

To also allow leaning of the vacuum cleaner towards a vertical surface, e.g. a wall, without tipping sideways, the rear end of the handle is, in a preferred embodiment, provided with a confined slip reducing surface. This slip reducing surface may preferably be formed as a part-spherical surface or bump in cross section.

The slip reducing layer may be formed and attached to the vacuum cleaner in many different ways. It can e.g. be attached by means of double-stick tape or adhesive bonding. It can also be slid into a groove formed in the support body. Moreover, the slip reducing layer may be provided with protrusions on the inner surface, which are pushed into holes, such as countersunk screw holes in the support body. This has the further advantage that the screw holes will be hidden by the slip reducing layer. It is also conceivable to mould the slip reducing layer in a liquid or plastic state onto a portion of the support body, and let the liquid substance flow into holes, grooves, behind edges or the like, which, after subsequent hardening, will cause the slip reducing layer to be in engagement with the support body. It is also possible to attach the slip reducing layer by means of for example rivets or screws.

To enhance the slip reducing function, it is advantageous to provide the outer surface of the slip reducing layer with some kind of surface structure. Such surface structure may be in form of for example grooves, ridges or pimples. It has appeared as especially advantageous to form the surface structure of an elongated slip reducing strip as shark fins or saw teeth in longitudinal section. In this way the surface structure may hook onto e.g. a table top when leaned towards the same.

Irrespective of providing the slip reducing layer with a surface structure or not, it is preferred to form the layer of a relatively soft and elastic material, presenting a high surface friction, such as rubber or synthetic rubber. The latter may be manufactured to a low cost and formed as desired and is available in various chemical compositions.

BRIEF DESCRIPTION OF THE DRAWINGS

Preferred embodiments of the invention are hereinafter described with reference to the accompanying drawings, in which.

DETAILED DESCRIPTION OF PREFERRED EMBODIMENTS OF THE INVENTION

Figure 1:
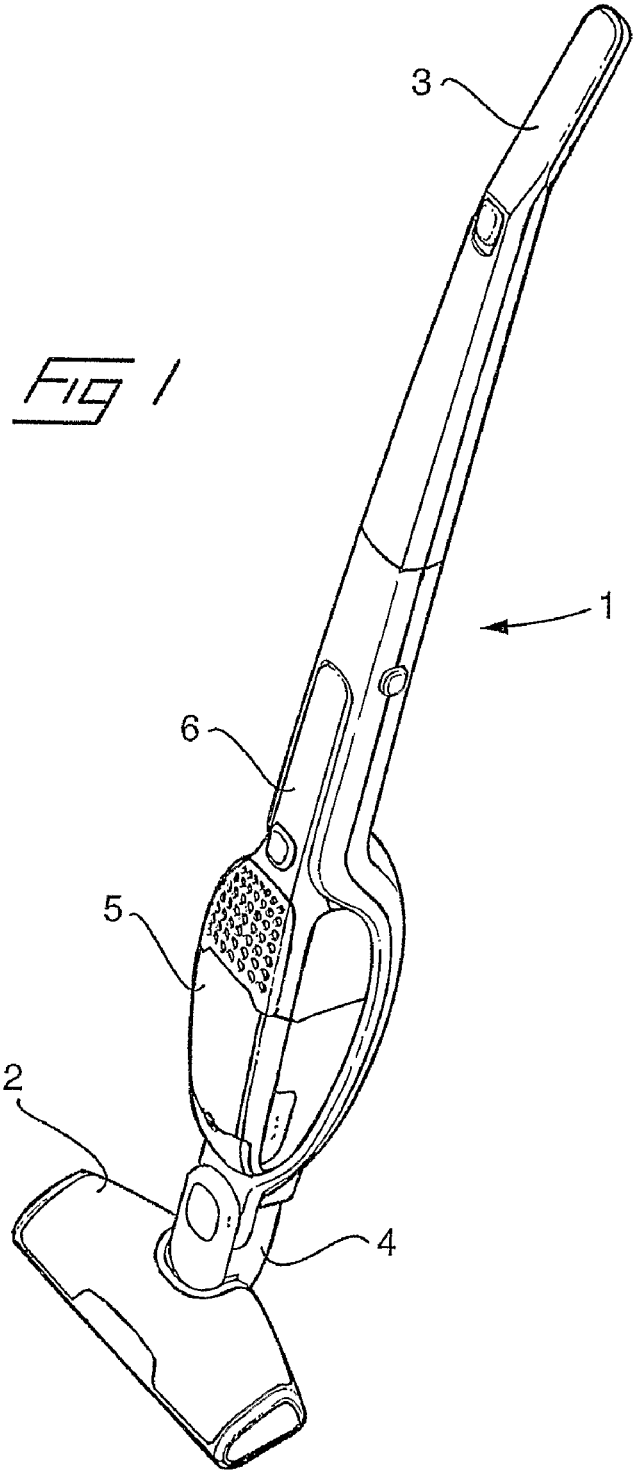
FIG. 1 is a perspective view of an exemplary vacuum cleaner to which the invention is applicable.

Reference is first made to FIG. 1 in which is illustrated a vacuum cleaner of the general kind being intended for the present invention. The vacuum cleaner comprises an elongated, stick formed support body 1 having a nozzle device 2 in its lower end and a handle part 3 in its upper end. The nozzle device 2 is connected to the support body by means of a joint 4 such that the nozzle device is pivotable in a plane in parallel as well as a plane perpendicular to the support body. As seen from the drawings, the handle part 3 is angled in relation to the support body 1.

The illustrated vacuum cleaner is of the kind having a separate vacuum unit 5, which in the drawings is shown mounted in a mounting recess in the support body, but which also is detachable to be used as a handheld vacuum cleaner. For this reason the vacuum unit 5 comprises an electric motor, a fan, a debris collecting compartment, a handle 6 in its upper end and an integrated nozzle in its lower end. In the mounted state of the vacuum unit in the support body, the integrated nozzle is connectable to the support body to set the vacuum unit in fluid communication with the nozzle device in the lower end of the support body. To facilitate working with the vacuum cleaner, it is provided with a battery in the detachable vacuum unit 5, which supplies power to the electric motor both in the mounted state of the vacuum unit, when the stick formed vacuum cleaner is used to vacuum clean e.g. floors, as well as in the detached state of the vacuum unit when it is used as a handheld vacuum cleaner. To the vacuum cleaner also belongs a stand (not shown in the drawings), in which the vacuum cleaner is positioned when it is not in use and at the same time the battery is charged.

Figure 2:
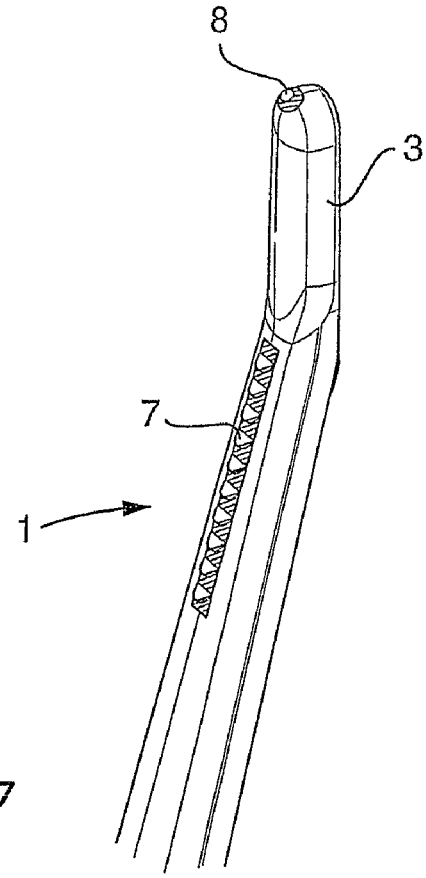
FIG. 2 is a rear view of the upper portion of the support body showing the preferred positioning of two different slip reducing layers according to the invention.

Now reference is made to FIG. 2, in which is illustrated the upper, rear part of the support body 1 including the handle 3. According to the invention, the vacuum cleaner is provided with an elongated slip reducing strip 7 in the area immediately beneath the handle 3, and a slip reducing bump 8 in the upper end of the handle. Both the strip 7 and the bump 8 is manufactured of a high friction material. As is indicated in the drawing, the strip 7 is preferably provided with a surface structure in form of pimples, whereas the bump 8 is smooth but preferably has a part-spherical shape in cross section. Both the strip 7 and the bump 8 can be attached in any suitable way, e.g. by means of any of the methods as mentioned hereinbefore.

Figure 3:
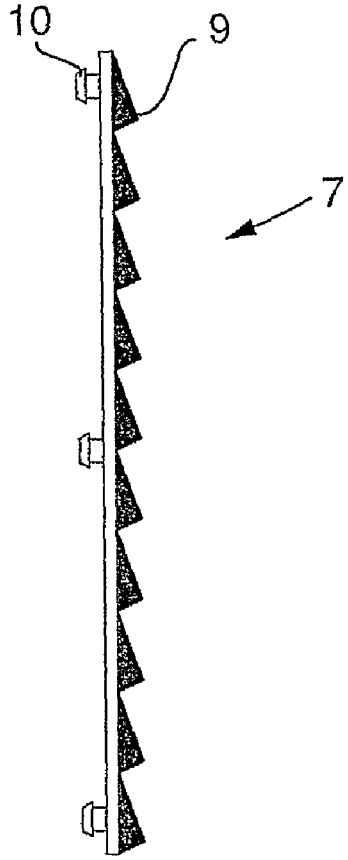
FIG. 3 is a longitudinal section through a slip reducing strip showing a surface structure in form of shark fins or saw teeth on the outside and attachments in form of projections to be inserted into countersunk screw holes in the support body on the inside.

In FIG. 3 is illustrated an alternative embodiment of the slip reducing strip 7. Here the strip is provided with a surface structure on the outside, which has particularly favourable slip reducing characteristics. More precisely the strip is provided with ridges 9 transverse to the strip length. Seen in longitudinal section of the strip, the ridges 9 are formed as shark fins or saw teeth, which will give an excellent grip against the edge of a table top or the like. On the inner surface the strip 7 is provided with projections 10, which are adapted to be pressed into respective holes in the support body to fasten the strip 7 thereto.

Figure 4:
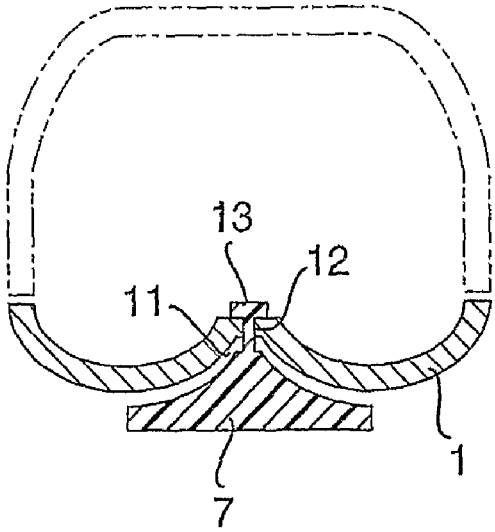
FIG. 4 is a cross section through an alternative embodiment of a rear body portion having a cast on strip of a slip reducing material.

In FIG. 4 is shown an additional alternative embodiment for forming and attaching of a slip reducing strip 7 to the support body. Here a rear half of the support body 1 is shown in cross section and, as is shown, the support body is in the longitudinal direction formed with a centric positioned groove 11. The strip 7 is cast formed over the groove 11 on the support body in a liquid or plastic state and subsequently hardened. By for example provide the support body with through holes 12, the liquid or plastic compound may penetrate into the holes and, after subsequent hardening, form attaching members 13, which attaches the strip 7 securely to the support body.

Figure 5:
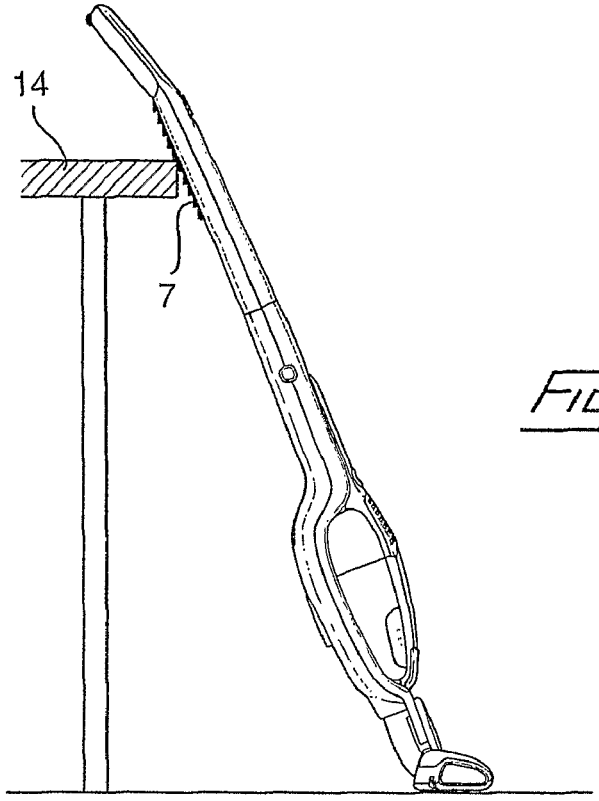
FIG. 5 is a side view of a vacuum cleaner leaned against a table top.
Figure 6:
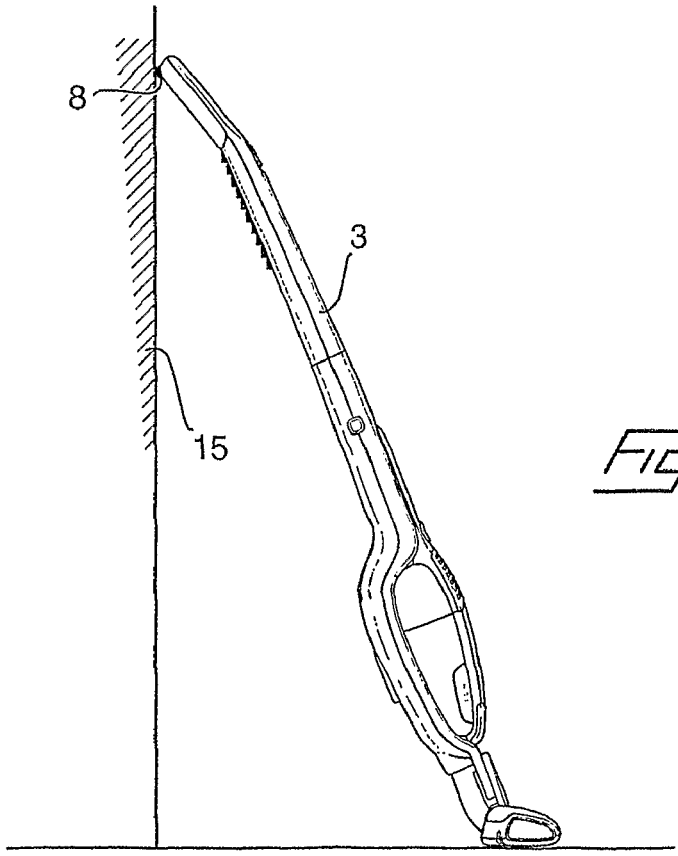
FIG. 6 is a side view of a vacuum cleaner leaned against a wall.

FIGS. 5 and 6 illustrate the benefits of providing a vacuum cleaner with slip reducing layers according to the invention. Accordingly, the vacuum cleaner can be leaned against the edge of a table top 14, as is shown in FIG. 5, such that the elongated strip 7 on the rear side of the support body bear against the edge, which will prevent the vacuum cleaner to slide forwards and fall to the floor. With a slip reducing bump 8 on the upper end of the handle 3, the vacuum cleaner also can be leaned towards a wall 15, as is shown in FIG. 6, without the risk of falling sideways to the floor.

The invention claimed is:

1. A vacuum cleaner comprising:

an elongated support body having a handle at an upper end of the support body the handle comprising a grip adapted to be gripped by a user to operate the vacuum cleaner, a nozzle device attached to a lower end of the support body by a rotatable joint, and a vacuum unit comprising an electric motor and a fan, and a debris collecting compartment, being accommodated in the support body, wherein the support body comprises a layer of a slip reducing material attached at least on a rear surface thereof, the layer of slip reducing material being positioned on the support body between the grip and the nozzle device.

2. A vacuum cleaner of claim 1, wherein the support body is angled in an upper portion to form the handle.

3. A vacuum cleaner of claim 1, wherein a slip preventing bump is attached on the upper end of the handle.

4. A vacuum cleaner of claim 1, wherein the slip reducing material comprises one or more projections that are inserted and attached by press fit into one or more corresponding holes in the support body.

5. A vacuum cleaner of claim 1, wherein the slip reducing material comprises a surface structure adapted to increase the slip resistance of the slip reducing material.

6. A vacuum cleaner of claim 5, wherein the surface structure comprises one or more projections.

7. A vacuum cleaner of claim 6, wherein the one or more projections are generally triangular as seen transverse to a longitudinal section of the strip.

8. A vacuum cleaner of claim 1, wherein the nozzle device comprises wheels for rolling against a surface to be cleaned.

9. A vacuum cleaner comprising:

an elongated support body having a top end and a lower end;

a handle extending upward from the top end of the support body, the handle configured to be gripped by a user;

a nozzle device attached to the lower end of the support body by a rotatable joint;

a vacuum unit comprising an electric motor and a fan;

a debris collecting compartment accommodated in the support body and in fluid communication with the nozzle device and the vacuum unit such that operating the vacuum unit moves air from the nozzle device and through the debris collecting compartment; and a layer of a slip reducing material attached to the rear surface of the elongated support body between the top end and the lower end thereof.

* * * * *